US009551511B2

(12) United States Patent
Alahyari et al.

(10) Patent No.: US 9,551,511 B2
(45) Date of Patent: Jan. 24, 2017

(54) EJECTOR HAVING NOZZLES AND DIFFUSERS IMPARTING TANGENTIAL VELOCITIES ON FLUID FLOW

(75) Inventors: Abbas A. Alahyari, Manchester, CT (US); Miad Yazdani, Oak Park, IL (US)

(73) Assignee: Carrier Corporation, Jupiter, FL (US)

( * ) Notice: Subject to any disclaimer, the term of this patent is extended or adjusted under 35 U.S.C. 154(b) by 412 days.

(21) Appl. No.: 13/996,154

(22) PCT Filed: Jan. 18, 2012

(86) PCT No.: PCT/US2012/021640

§ 371 (c)(1),
(2), (4) Date: Jun. 20, 2013

(87) PCT Pub. No.: WO2012/108982

PCT Pub. Date: Aug. 16, 2012

(65) Prior Publication Data

US 2013/0305776 A1 Nov. 21, 2013

Related U.S. Application Data

(60) Provisional application No. 61/440,921, filed on Feb. 9, 2011.

(51) Int. Cl.
*F25B 1/06* (2006.01)
*F04F 5/04* (2006.01)
(Continued)

(52) U.S. Cl.
CPC . *F25B 1/06* (2013.01); *F04F 5/00* (2013.01); *F04F 5/02* (2013.01); *F04F 5/04* (2013.01);
(Continued)

(58) Field of Classification Search
CPC ..... F25B 1/06; F25B 41/00; F25B 2341/0012; F25B 2341/0013; F25B 9/08; F04F 5/00; F04F 5/06; F04F 5/42; F04F 5/46; F04F 4/461; F04F 5/02; F04F 5/04; F04F 5/464
(Continued)

(56) References Cited

U.S. PATENT DOCUMENTS 1,120,526 A * 12/1914 Patton ..... F04F 5/46 417/151
1,473,037 A * 11/1923 Greig ..... F04F 5/20 417/183
(Continued)

FOREIGN PATENT DOCUMENTS

FR 2233511 A1 1/1975
FR 2599093 A1 11/1987
(Continued)

OTHER PUBLICATIONS

Chinese Office Action for Chinese Patent Application No. 201280008132.8, dated May 29, 2015.
(Continued)

*Primary Examiner* — Orlando E Aviles Bosques
(74) *Attorney, Agent, or Firm* — Bachman & LaPointe, P.C.

(57) ABSTRACT

An ejector (38) has ports (40, 42, 44) for receiving a motive flow and a suction flow and discharging a combined flow. The ejector has a motive flow inlet, a suction flow inlet (42), and an outlet (44). A suction flow flowpath extends from the suction flow inlet. A motive flow flowpath extends from the motive flow inlet to join the suction flow flowpath and form a combined flowpath exiting the outlet. The ejector comprises a plurality of motive flow nozzles (100, 302, 402, 602, 702, 802) along the motive flow flowpath. The motive flow nozzles are oriented to impart a tangential velocity component to the motive flow. A plurality of diffusers (130, 304, 404, 604, 704, 804) are along the combined flowpath and are
(Continued)

oriented to recover the tangential velocity from the combined flow.

21 Claims, 8 Drawing Sheets

(51) Int. Cl.

| | |
|---|---|
| ***F04F 5/46*** | (2006.01) |
| ***F04F 5/02*** | (2006.01) |
| ***F04F 5/42*** | (2006.01) |
| ***F04F 5/00*** | (2006.01) |
| ***F25B 41/00*** | (2006.01) |
| ***F25B 43/00*** | (2006.01) |
| *F25B 9/08* | (2006.01) |

(52) U.S. Cl.
CPC . *F04F 5/42* (2013.01); *F04F 5/46* (2013.01); *F04F 5/464* (2013.01); *F25B 41/00* (2013.01); *F25B 43/006* (2013.01); *F25B 9/08* (2013.01); *F25B 2341/0012* (2013.01); *F25B 2341/0014* (2013.01); *F25B 2400/23* (2013.01); *F25B 2500/01* (2013.01)

(58) Field of Classification Search
USPC ..... 417/167, 171
See application file for complete search history.

(56) References Cited

U.S. PATENT DOCUMENTS

| | | | | | |
|---|---|---|---|---|---|
| 1,836,318 | A | | 12/1931 | Gay | |
| 1,963,295 | A | * | 6/1934 | Deutsch | F04F 5/467 417/167 |
| 2,247,005 | A | * | 6/1941 | Trofimov | F04F 5/469 417/165 |
| 3,277,660 | A | | 10/1966 | Kemper et al. | |
| 3,739,576 | A | * | 6/1973 | Chamberlain | F23R 3/10 417/171 |
| 4,029,724 | A | * | 6/1977 | Muller | B01F 3/04617 261/93 |
| 4,378,681 | A | | 4/1983 | Modisette | |
| 4,388,045 | A | * | 6/1983 | Simon | F04F 5/42 417/171 |
| 4,449,862 | A | * | 5/1984 | Beck | B01F 5/0057 37/195 |
| 4,487,553 | A | | 12/1984 | Nagata | |
| 4,749,336 | A | | 6/1988 | Rojey | |
| 5,117,648 | A | | 6/1992 | Kowalski et al. | |
| 5,239,837 | A | | 8/1993 | Kowalski et al. | |
| 5,309,736 | A | | 5/1994 | Kowalski et al. | |
| 5,647,221 | A | | 7/1997 | Garris, Jr. | |
| 6,138,456 | A | | 10/2000 | Garris | |
| 6,434,943 | B1 | * | 8/2002 | Garris | H01M 8/04089 417/178 |
| 6,547,520 | B2 | | 4/2003 | Zinsmeyer et al. | |
| 6,814,540 | B2 | | 11/2004 | Sishtla et al. | |
| 6,904,769 | B2 | * | 6/2005 | Ogata | F04F 5/04 417/187 |
| 7,497,666 | B2 | | 3/2009 | Garris, Jr. | |
| 7,802,432 | B2 | * | 9/2010 | Erno | B05B 1/30 239/455 |
| 2006/0266072 | A1 | | 11/2006 | Takeuchi et al. | |
| 2009/0324429 | A1 | * | 12/2009 | Azimov | B01F 3/0446 417/198 |
| 2015/0176606 | A1 | * | 6/2015 | Yamada | F04F 5/18 417/190 |
| 2015/0330671 | A1 | * | 11/2015 | Suzuki | F04F 5/04 62/500 |

FOREIGN PATENT DOCUMENTS

| | | | |
|---|---|---|---|
| JP | 59202000 | A | 11/1984 |
| JP | 2008202812 | A | 9/2008 |
| WO | 2009114176 | A2 | 9/2009 |

OTHER PUBLICATIONS

Chinese Office Action for Chinese Patent Application No. 201280008132.8, dated Nov. 3, 2014.

International Search Report and Written Opinion for PCT/US2012/021640, dated Mar. 26, 2012.

* cited by examiner

EJECTOR HAVING NOZZLES AND DIFFUSERS IMPARTING TANGENTIAL VELOCITIES ON FLUID FLOW

CROSS-REFERENCE TO RELATED APPLICATION

Benefit is claimed of U.S. Patent Application Ser. No. 61/440,921, filed Feb. 9, 2011, and entitled "Ejector", the disclosure of which is incorporated by reference herein in its entirety as if set forth at length.

BACKGROUND

The present disclosure relates to refrigeration. More particularly, it relates to ejector refrigeration systems.

Ejectors are used as expansion devices in vapor compression refrigeration systems. Ejectors may be used to recover work to allow operational conditions and/or configurations not available with a traditional expansion device. Earlier proposals for ejector refrigeration systems are found in U.S. Pat. Nos. 1,836,318 and 3,277,660.

A typical ejector utilizes a motive (primary) flow of fluid to entrain a secondary (suction) flow. A common ejector configuration includes a motive (primary) inlet coaxial with a downstream outlet. The ejector also has a secondary inlet. The exemplary primary inlet is the inlet of a motive (primary) nozzle nested within an outer member. The outlet is the outlet of the outer member. The primary flow enters the primary inlet and then passes into a convergent section of the motive nozzle. It then passes through a throat section and an expansion (divergent) section and through an outlet of the motive nozzle. The motive nozzle accelerates the primary flow and decreases the pressure of the primary flow. The secondary inlet forms an inlet of the outer member and may be a lateral port. The pressure reduction caused to the primary flow by the motive nozzle helps draw the secondary flow into the outer member.

The outer member includes a mixer having a convergent section and an elongate throat or mixing section. The outer member also has a divergent section or diffuser downstream of the elongate throat or mixing section. The motive nozzle outlet is positioned within the convergent section. As the primary flow exits the motive nozzle outlet, it begins to mix with the secondary flow with further mixing occurring through the mixing section which provides a mixing zone.

In transcritical refrigeration operation, the primary flow may typically be supercritical upon entering the ejector and subcritical upon exiting the motive nozzle. The secondary flow may be is gaseous (or a mixture of gas with a smaller amount of liquid) upon entering the secondary inlet port. The resulting combined flow may be a liquid/vapor mixture and decelerate and recover pressure in the diffuser while remaining a mixture.

SUMMARY

Accordingly, one aspect of the disclosure involves an ejector for receiving a motive flow and a suction flow and discharging a combined flow. The ejector has a motive flow inlet, a suction flow inlet, and an outlet. A suction flow flowpath extends from the suction flow inlet. A motive flow flowpath extends from the motive flow inlet to join the suction flow flowpath and form a combined flowpath exiting the outlet. The ejector comprises a plurality of motive flow nozzles along the motive flow flowpath. The motive flow nozzles are oriented to impart a tangential velocity component to the motive flow. A plurality of diffusers are along the combined flowpath and are oriented to recover the tangential velocity from the combined flow.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
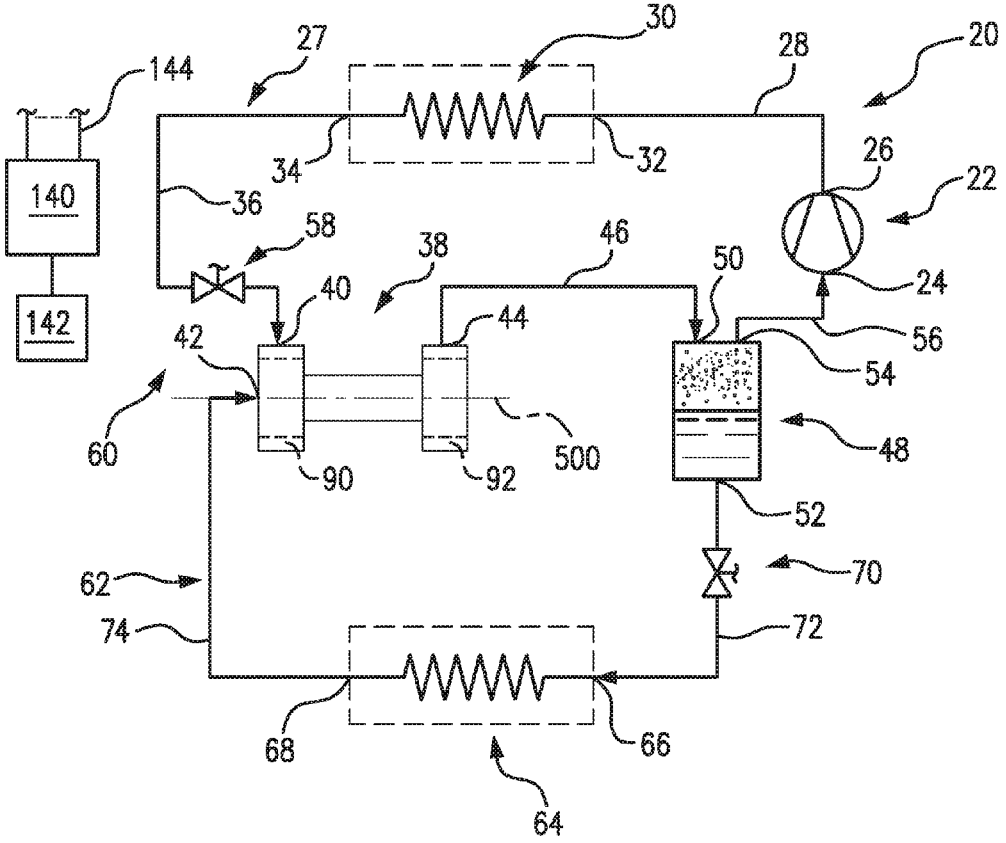
FIG. 1 is a schematic view of a first vapor compression system.

FIG. 1 shows a vapor compression system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary (motive flow) inlet 40 (liquid or supercritical or two-phase inlet) of an ejector 38. The ejector 38 also has a secondary (suction flow) inlet 42 (a saturated or superheated vapor or two-phase inlet) and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 secondary inlet 42 is an axial upstream inlet along a central longitudinal axis 500 of the ejector. The exemplary primary inlet 40 is the inlet to an inlet plenum 90. The inlet plenum 90 feeds a plurality of motive nozzles (discussed below). The outlet 44 is an outlet from an outlet plenum 92. The outlet plenum 92 receives flow from a plurality of diffusers (discussed below).

Figure 2:
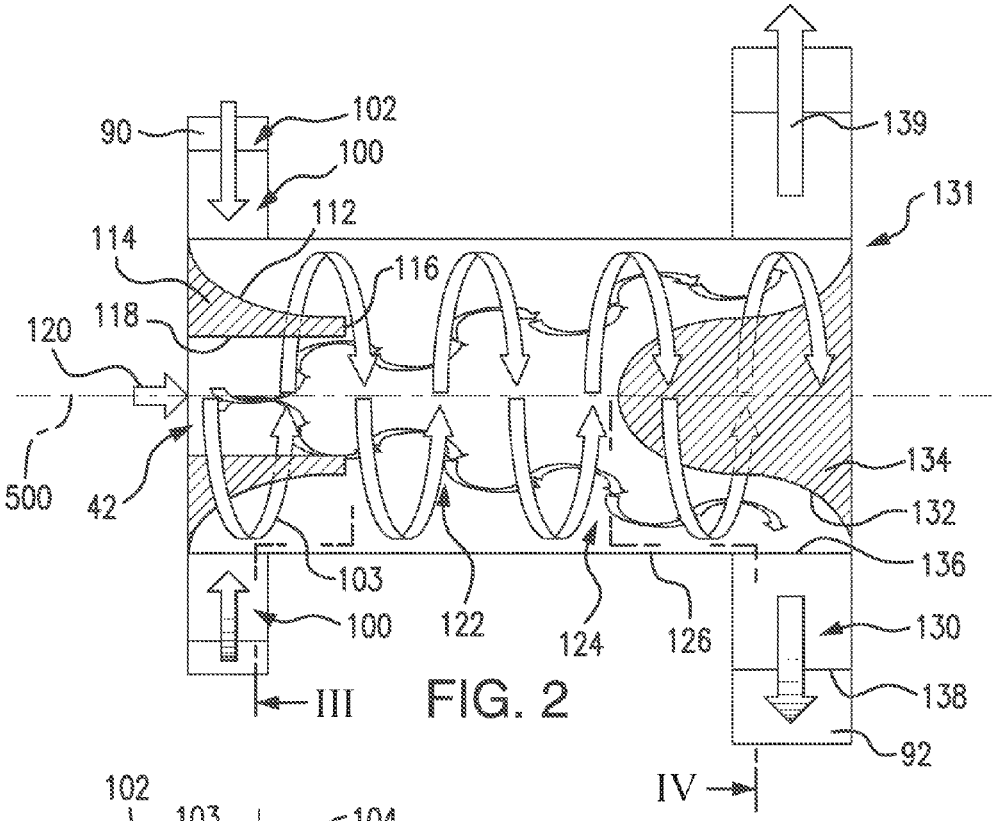
FIG. 2 is a schematic sectional view of an ejector of the system of FIG. 1.

FIG. 2 shows a circumferential array of motive nozzles 100. The exemplary nozzles are formed in a single nozzle ring (e.g., machined or cast). Each motive nozzle has a radially outboard inlet 102 at the inlet plenum.

Figure 3:
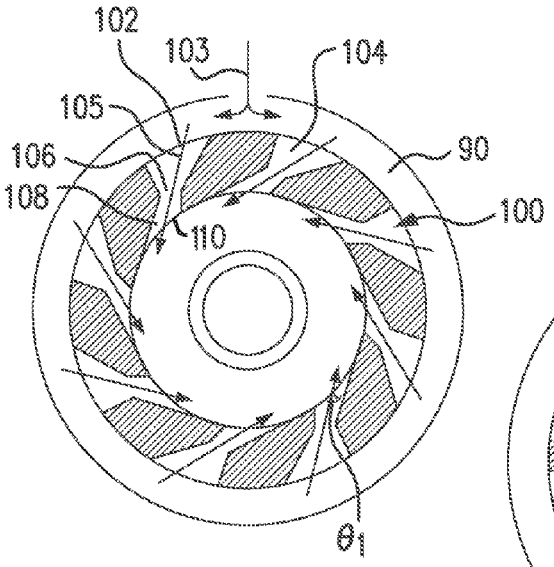
FIG. 3 is a transverse sectional view of a motive nozzle portion of the ejector of FIG. 2 taken along line III.
Figure 4:
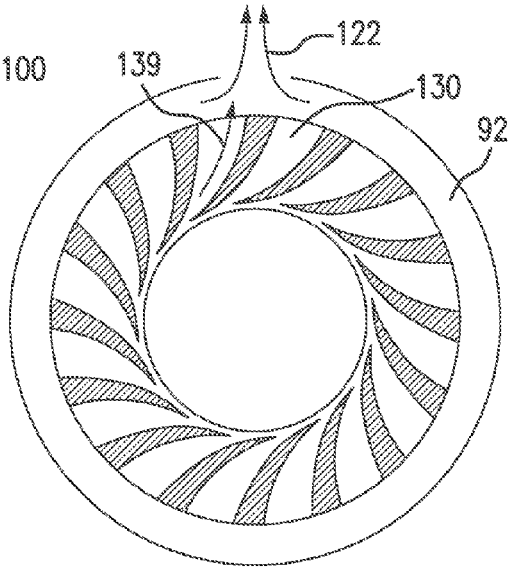
FIG. 4 is a transverse sectional view of a diffuser portion of the ejector of FIG. 2 taken along line IV.

The primary refrigerant flow 103 (FIG. 3) branches in the inlet plenum into branches 105 entering the inlets 102. Each primary flow branch 105 then passes into a convergent section 104 of the associated motive nozzle 100. It then passes through a throat section 106 and an expansion (divergent) section 108 and through an outlet 110 of each motive nozzle 100 to re-merge and re-form the flow 103. The motive nozzles 100 accelerate the flow 103 and decreases the pressure of the flow. The merging flows have a tangential/circumferential component and a radial inward component. They are then deflected axially by a surface 112 of a centerbody 114 (inlet end centerbody or upstream end centerbody) extending to a downstream rim 116. An inboard surface 118 of the body defines a channel from the secondary inlet passing the secondary flow 120. The pressure reduction caused to the primary flow by the motive nozzles helps draw the secondary flow 120 (FIG. 2) into the ejector to form a merged/combined flow 122.

The ejector includes a mixer portion having an elongate mixing section 124 within an outer wall 126.

The ejector also has a circumferential array of divergent sections or diffusers 130 at a downstream end 131 of the ejector downstream of the mixing section 124. The combined flow passes downstream through the mixing section 124 and is redirected radially outward by an outer surface 132 of a centerbody 134. Exemplary diffusers have inlets 136 and outlets 138. The combined flow branches into respective branches 139 through each of the diffusers to then recombine into the combined flow 122 in the plenum 92. Each diffuser has a tangential component near the inlet end essentially opposite the tangential component of the motive nozzles, gradually redirecting the flow more radially to recover the energy associated with the tangential velocity. In exemplary embodiments, there are 4-8 motive flow nozzles (more broadly at least two or 3-10) and 4-16 diffusers (more broadly, at least two or 3-20).

In operation, the primary flow 103 may typically be supercritical upon entering the ejector and subcritical upon exiting the motive nozzles. The secondary flow 120 may be gaseous (or a mixture of gas with a smaller amount of liquid) upon entering the secondary inlet port 42. The resulting combined flow is a liquid/vapor mixture and decelerates and recovers pressure in the diffusers while remaining a mixture. Upon entering the separator, the combined flow is separated back into the flows 103 and 120. The flow 103 passes as a gas through the compressor suction line as discussed above. The flow 120 passes as a liquid to the expansion valve 70. The flow 120 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

The motive nozzles may be controllable to enable the ejector operate under variable system capacities. For instance, when the system is operating at its full-load conditions, all the motive nozzles may be fully open to supply the necessary mass flow 103 into the mixer. However, the mass flow could vary as the speed of the compressor 22 changes without a dramatic change in temperature. In these circumstances, some nozzles may be closed to reduce the net/effective open area and effectively maintain the high tangential velocity entering the mixing section.

The system includes a controller 140 which may receive user inputs from an input device 142 (e.g., switches, keyboard, or the like) and sensors (not shown). The controller 140 may be coupled to any controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Figure 6:
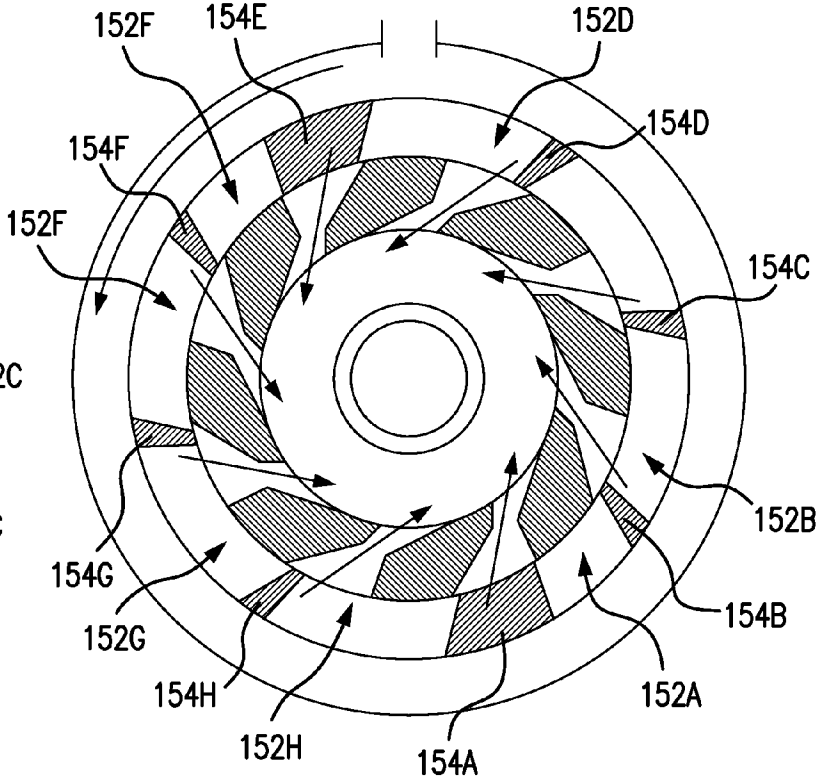
FIG. 6 is a view of the motive nozzle portion of FIG. 5 in a relatively closed condition.
Figure 5:
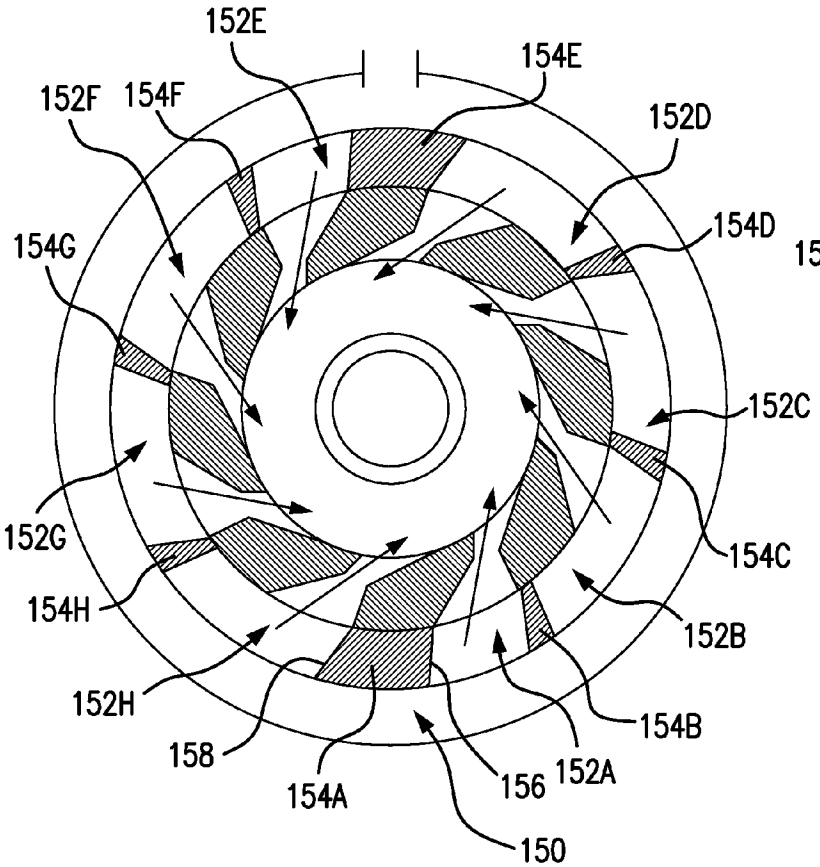
FIG. 5 is a transverse sectional view of an alternate motive nozzle portion in an open condition.

FIGS. 5 and 6 show the addition of a rotary gate (or control ring) 150 controlling flow through the inlets 102. Exemplary gate 150 is a ring concentric with and surrounding the nozzle ring and having a series of open areas 152 (of which 152A-H are shown) interspersed with blocking portions/areas 154 (154A-H). The exemplary number of open areas 152 and blocking portions 154 is the same as the number of nozzles. However, the exemplary nozzles are at a uniform circumferential spacing and have a uniform circumferential extent of the openings/inlets 102. In the orientation of FIG. 5, each of the blocking portions 154 is clear of the adjacent openings 102 thus providing essentially no occlusion/blocking of the openings. As the ring is rotated toward a second condition of FIG. 6, the blocking portions progressively occlude the adjacent inlet 102. Thus, FIG. 6 shows a relatively closed condition. By providing the blocking portions 154 at other than even/uniform circumferential spacing and/or uniform circumferential extent, the nature of the closing process may be altered. For example, with uniform size and uniform spacing, each nozzle would be closed/occluded simultaneously in a similar fashion. This may have disadvantages in terms of placing individual nozzles in substantially suboptimal performance conditions. Accordingly, the blocking portions 154A and 154E are of relatively large circumferential extent compared with the remainder. These begin to occlude the adjacent nozzles relatively soon after rotating from the FIG. 5 open condition while the remaining blocking portions remain between nozzle inlets (leaving the associated nozzles unaffected). In the exemplary system, upon reaching the FIG. 6 condition, the blocking portions 154A and 154E fully close off their respective associated nozzles. In a final phase of this exemplary rotation, the remaining blocking portions just begin to occlude their associated nozzles to slightly throttle them down but not so far as to substantially adversely affect performance. In this particular implementation, each blocking portion has a leading surface 156 and a trailing surface 158. The exemplary trailing surfaces are at uniform circumferential separation so that, in the initial FIG. 5 orientation, each is adjacent the nozzle one before the nozzle to be occluded by that blocking portion (e.g., the trailing surface of blocking portion 154A is adjacent opening 152H). The exemplary ring has an inner surface at an inner diameter which seals against an outer surface of the ring containing the nozzles. For example, the nozzles may be machined or cast as a ring.

The ring 150 may be throttled to or toward the closed condition in response to a part-load condition where mass flow is reduced. For example, the ring position may be adjusted in response to or with a change in compressor speed (e.g., known by the controller which may provide the speed of a variable frequency drive of the compressor) or the output of a refrigerant flow sensor (not shown, e.g., at condenser/gas cooler outlet conditions along the line 36). The goal may be to maintain a high tangential velocity entering the ejector. For example, a control map, preprogrammed into the controller may cause the ring to provide particular restrictions associated with particular speeds (or flow rates) or ranges thereof. Similarly, in the situation of valves fully opening or closing individual nozzles, the map may associate the desired number of open nozzles with such ranges of speed or flow rate.

Figure 7:
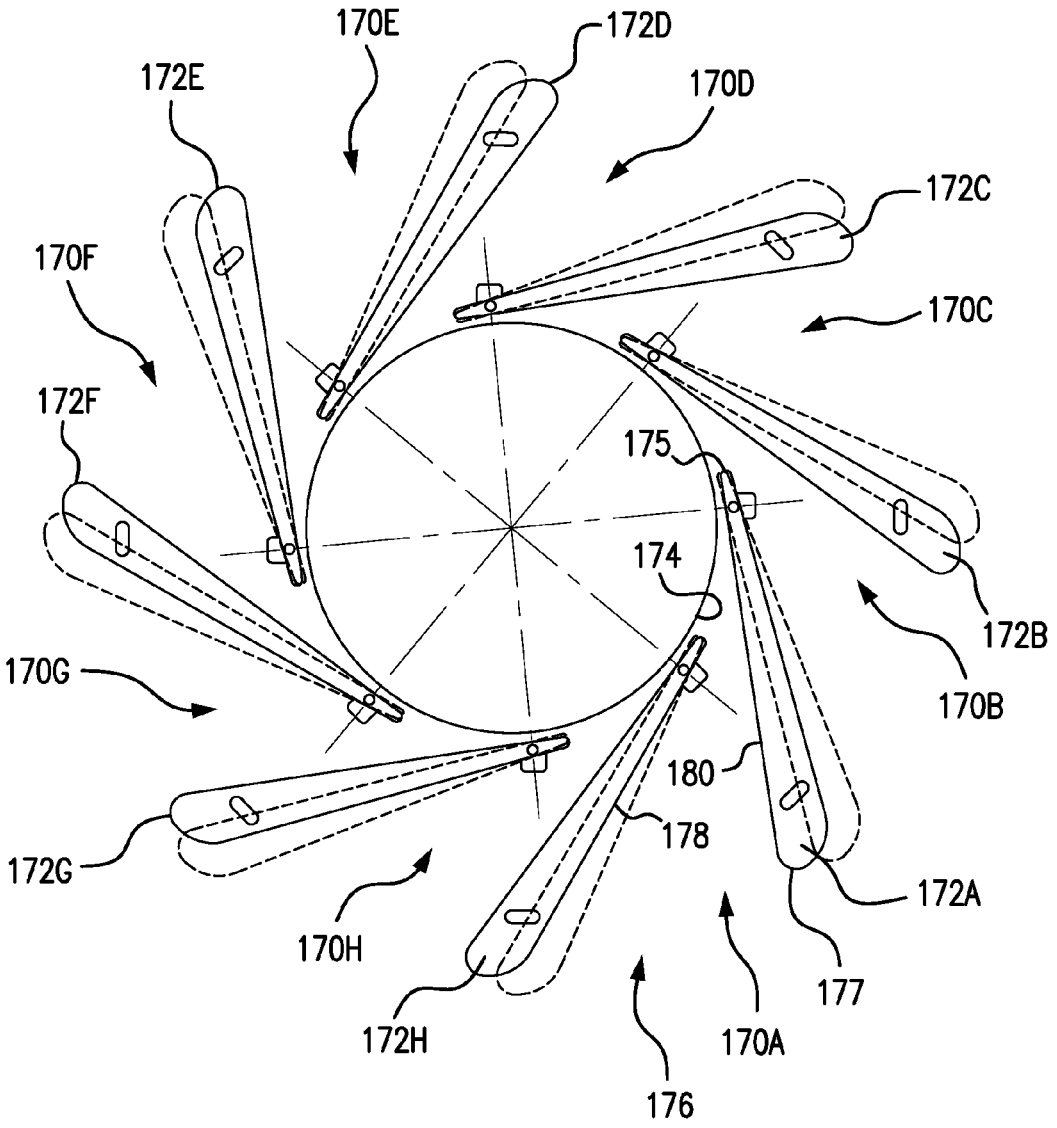
FIG. 7 is a partially schematic transverse cutaway view of an alternate diffuser portion.

Similarly, the angle and area ratio of the outlet diffusers may be made adjustable allowing control in response to operating condition. For example, FIG. 7 shows a variable vane diffuser such as used in centrifugal compressors and disclosed in U.S. Pat. Nos. 6,547,520 and 6,814,540. The variable vane diffuser has an array of diffuser passageways 170A-170H separated by vanes 172A-172H. Each diffuser passageway has an inboard inlet 174 (between inboard ends 175 of adjacent vanes) and an outboard outlet 176 (between outboard ends 177 of adjacent vanes). Exemplary vanes may articulate so as to allow at least partially independent control of inlet area and outlet area. FIG. 7 shows the articulation as consisting of a relative rotation of each vane about an inboard pivot 178 between a solid line condition and a broken line condition. The broken line condition effectively slightly increases the inlet area relative to the inlet area of the solid line condition.

The rotation may be used to adjust the diffuser inlet angle as well as its area ratio according to the incoming mass flow. This is to make sure that the diffuser is well aligned with the incoming flow angle, also to assure that the flow remains attached against the diffuser wall.

The controlling could be performed by a rotating ring (not shown) with pins at the location of vanes' slots. The rotation of the ring will be associated with the vanes being pushed by the pins inside the slots. The rotation may be actuated by a motor and gearing or via a tangential linear actuator. More complex configurations may provide more than one degree of vane adjustment. Similar to the inlet nozzle control, the outlet diffuser orientation may be controlled responsive to or with the compressor speed or refrigerant flow rate. As speed (or mass flow) is reduced, the controller will rotate the vanes to be less radial and more tangential (i.e., from the broken line showing toward the solid line showing). This better aligns the vanes with the velocity vector of discharged refrigerant. An increase in speed or flow rate would be associated with an opposite articulation of the diffuser.

Figure 8:
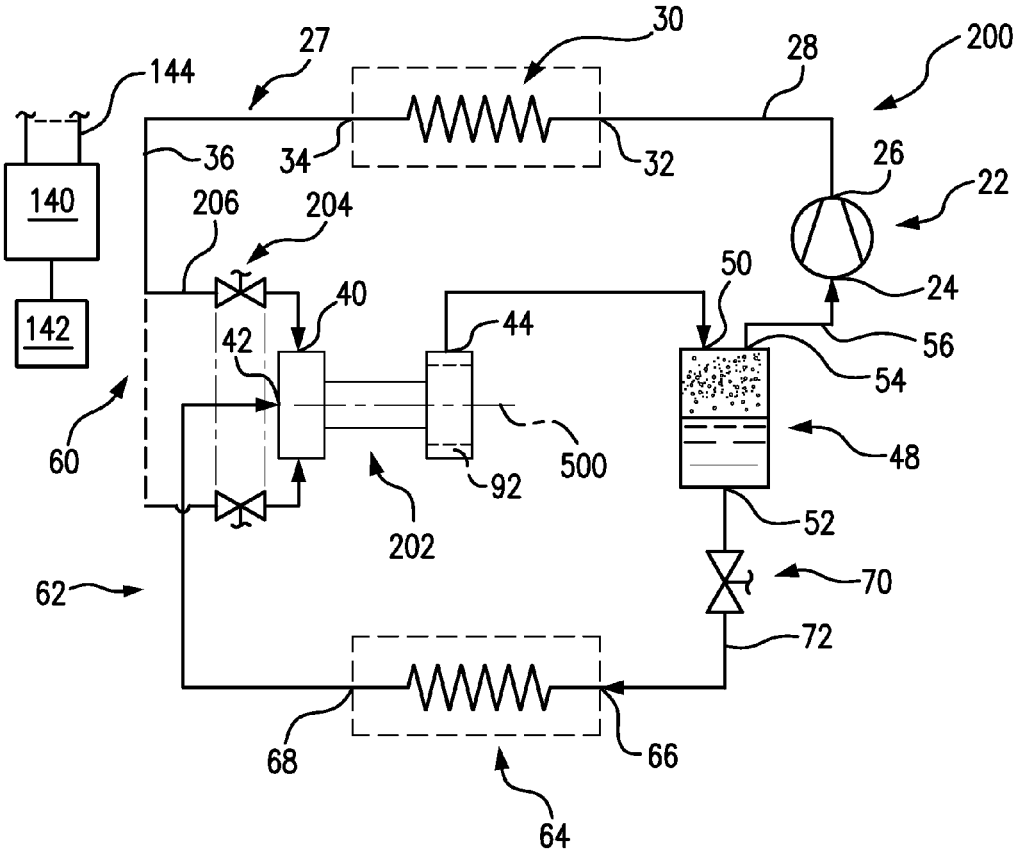
FIG. 8 is a schematic view of an alternate vapor compression system.

FIG. 8 shows an alternate system 200 having an ejector 202. One or more valves 204 are positioned to provide differential control of flows through the motive nozzles. In one example, the single shared inlet plenum 90 is eliminated and replaced by branch lines 206 feeding individual nozzles. In the example, there is a one-to-one correspondence between valves and motive nozzles so that there may be a fully independent control of flow through the motive nozzles. In other embodiments, valves might be consolidated to feed multiple nozzles (e.g., a switching valve for each two nozzles providing flow through both, one, or none). In yet other versions, a single valve 58 (FIG. 1) may control flow through all the motive nozzles.

FIGS. 9-19 show flow patterns for ejectors with alternate configurations of motive nozzles and/or diffusers. Thus, the ejectors are illustrated by the outline of the flows through the ejectors without showing wall thickness, etc. Such ejectors may be used in place of the ejectors above.

Figure 9:
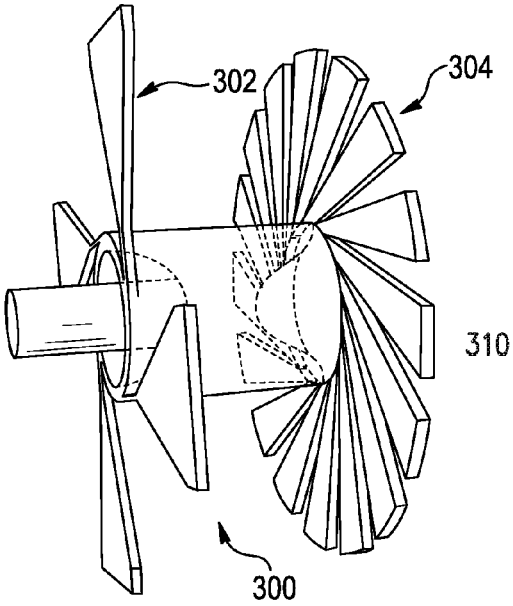
FIG. 9 is a view of an alternate ejector.
Figure 10:
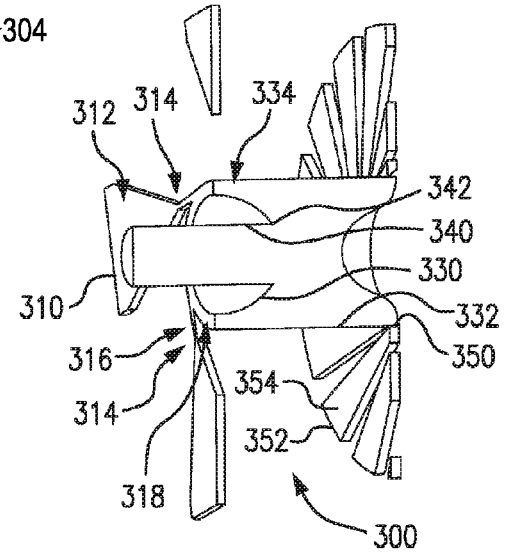
FIG. 10 is an axial sectional view of the ejector of FIG. 9.

The ejector 300 of FIGS. 9 and 10 features motive nozzles 302 and diffusers 304. Each nozzle 302 has an associated inlet 310, a convergent section 312 downstream thereof, and a throat 314 downstream of the convergent section. In the exemplary configuration, each nozzle 302 has its own beginning of a divergent section 316 downstream of the throat 314. These sections 316 feed into an outboard upstream end 318 of the ejector core between an inboard wall 330 and an outboard wall 332. The inboard wall may, effectively, be the outboard wall of an upstream end centerbody similar to the centerbody 114 of FIG. 2. The wall 332 may form the outer wall of the mixing section in a similar fashion as the outer wall 126 of FIG. 2. The exemplary wall 330 is radially outwardly convex as the flows from the sections 316 merge and pass downstream, they continue to expand. Accordingly, an upstream outboard portion 334 of the core effectively provides the remainder of the expansion. The exemplary centerbody has an inboard wall 340 which meets the outboard wall 330 at a junction 342 wherein the motive and secondary flows mix. The convex profile of the surface 330 helps minimize losses associated with flow separation.

The diffuser centerbody may be similar to the centerbody 134 described above. Each exemplary diffuser 334 may extend from an inlet 350 at the downstream end of the core to an outlet 352 radially outboard thereof with a divergent section 354 therebetween.

Figure 11:
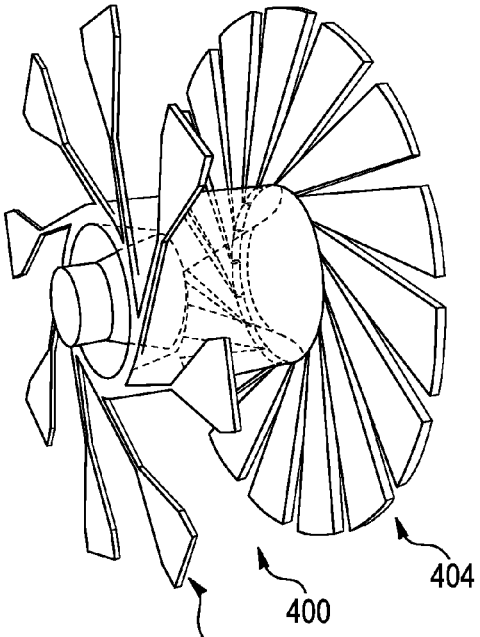
FIG. 11 is a view of a second alternate ejector.
Figure 12:
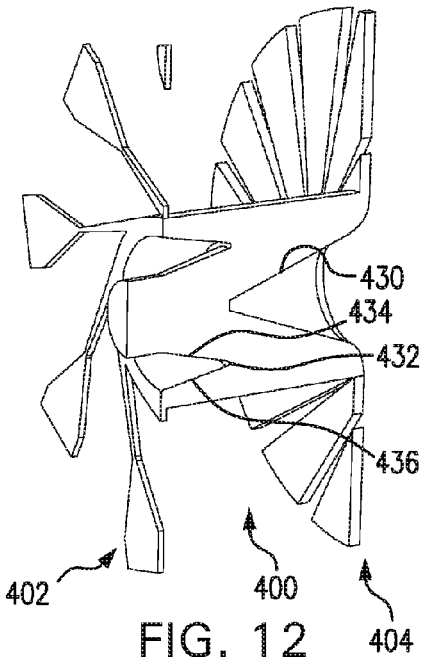
FIG. 12 is an axial sectional view of the ejector of FIG. 11.

The exemplary ejector 400 of FIGS. 11 and 12 features motive nozzles 402 and diffusers 404. The downstream centerbody has a nearly conical outer surface 430 which extends relatively forward to near or even upstream of the upstream centerbody rim 432 (e.g., upstream of so as to axially overlap). The upstream centerbody inboard surface 434 diverges radially, but the presence of the centerbody 430 may partially counter any expansive effect on the secondary flow. The upstream section centerbody outer surface 436 is shown as generally frustoconical, although other configurations may be used.

Figure 13:
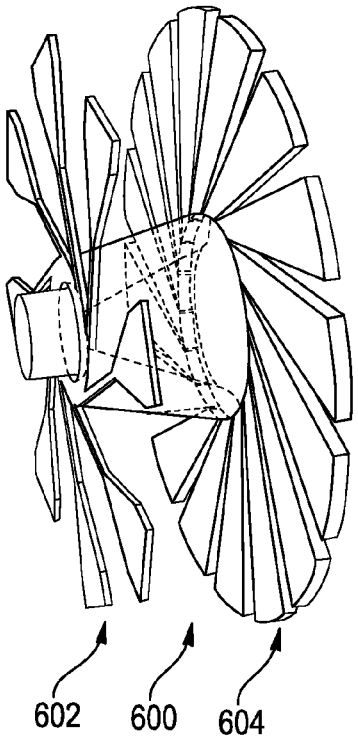
FIG. 13 is a view of a third alternate ejector.
Figure 14:
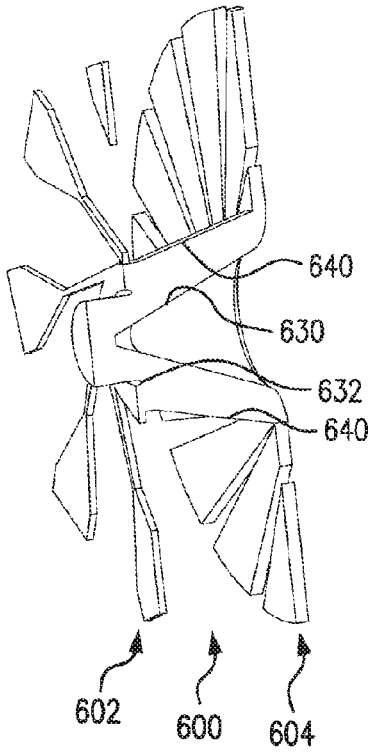
FIG. 14 is an axial sectional view of the ejector of FIG. 13.

The exemplary ejector 600 of FIGS. 13 and 14 features motive nozzles 602 and diffusers 604. The exemplary downstream centerbody outboard surface 630 is generally frustonical but extends yet further upstream compared to the surface 430 of FIG. 12. The expansion portion of the core wherein the motive flow expands prior to encountering the suction flow is relative foreshortened leaving only a small annular upstream centerbody having a downstream rim 632. In the illustrated configuration, the outer/outboard wall 640 of the core and mixing section diverges radially outward downstream. This divergence may help convert some of the tangential momentum into pressure as the motive flows mix with the suction flow.

Figure 15:
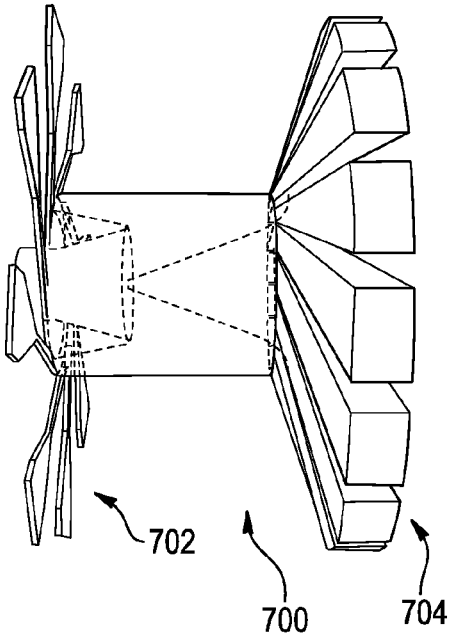
FIG. 15 is a view of a fourth alternate ejector.
Figure 16:
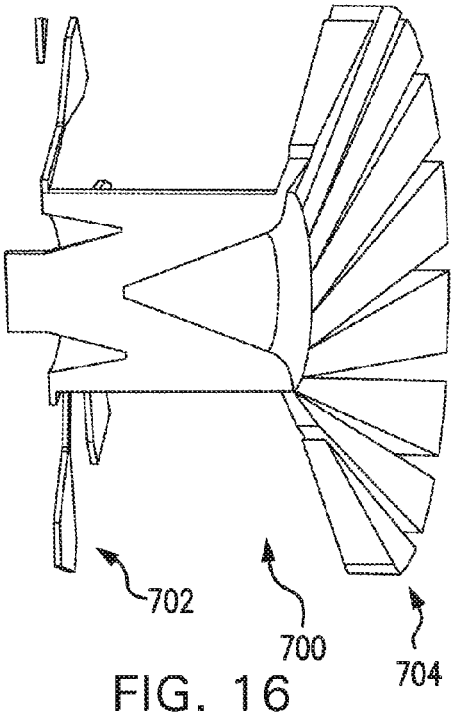
FIG. 16 is an axial sectional view of the ejector of FIG. 15.

The exemplary ejector 700 of FIGS. 15 and 16 features motive nozzles 702 and diffusers 704. Otherwise similar to the ejector 400, the diffusers expand the flow both circumferentially and axially and have a slight axial orientation (away from the inlet end) to help recover some of the axial momentum.

Figure 17:
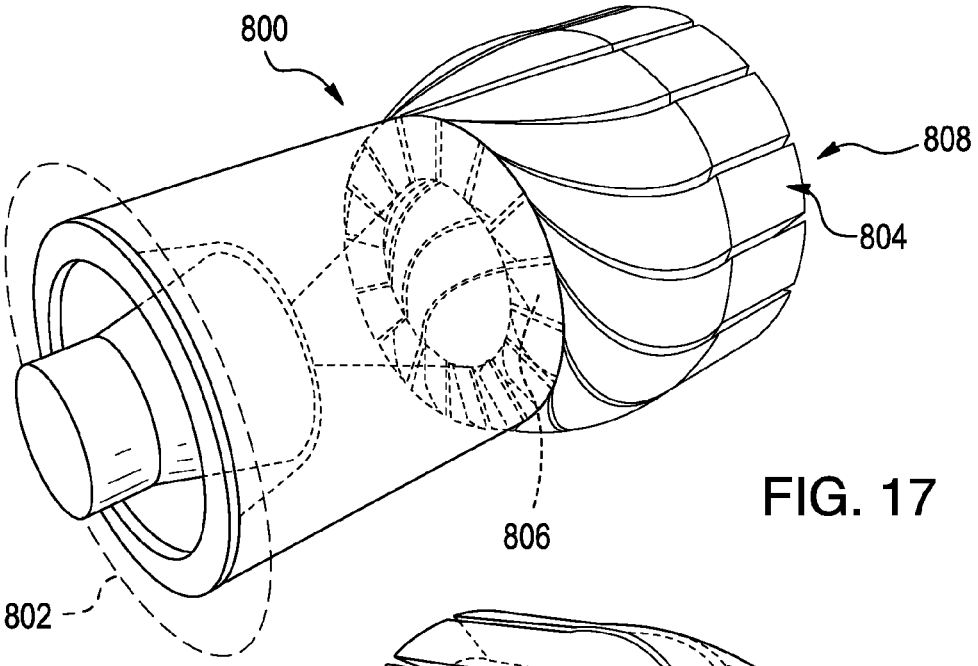
FIG. 17 is a view of a fifth alternate ejector.
Figure 18:
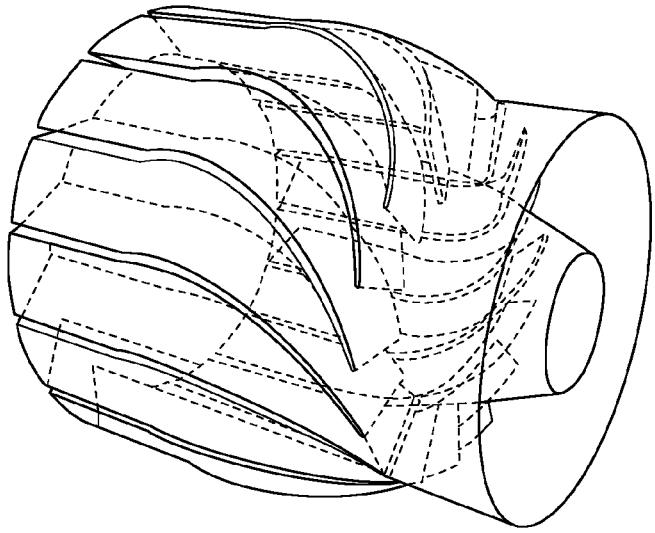
FIG. 18 is a transverse cutaway view of the ejector of FIG. 17.
Figure 19:
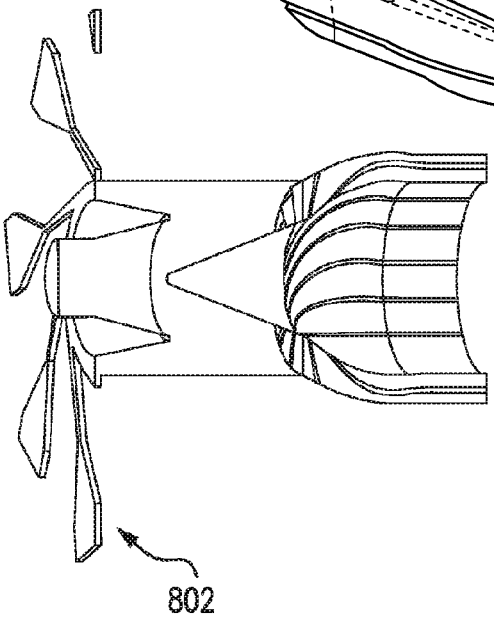
FIG. 19 is an axial sectional view of the ejector of FIG. 17.

The exemplary ejector 800 of FIGS. 17-19 may have an array of motive nozzles along the lines of any discussed above and schematically shown as 802. The diffusers 804 are relatively axial having inlets 806 and axial outlets 808.

Although an embodiment is described above in detail, such description is not intended for limiting the scope of the present disclosure. It will be understood that various modifications may be made without departing from the spirit and scope of the disclosure. For example, details of particular uses may influence details of the particular ejector. Accordingly, other embodiments are within the scope of the following claims.

What is claimed is:

1. An ejector (38; 202; 300; 400; 600; 700; 800) for receiving a motive flow and a suction flow and discharging a combined flow, the ejector comprising:

a motive flow inlet (40);

a suction flow inlet (42);

an outlet (44);

a suction flow flowpath extending from the suction flow inlet; and a motive flow flowpath extending from the motive flow inlet to join the suction flow flowpath and form a combined flowpath exiting the outlet, wherein the ejector comprises:

a plurality of motive flow nozzles (100; 302; 402; 602; 702; 802) along the motive flow flowpath, the motive flow nozzles oriented to impart a tangential velocity component to the motive flow;

an upstream end centerbody (114) having an inner surface (118; 340; 434) downstream of the suction flow inlet and a downstream-converging outboard surface (112; 330; 436) downstream of the motive flow inlet;

a downstream end centerbody (134) having a downstream divergent outboard surface (132; 430; 630) for radially outwardly diverting the combined flow; and a plurality of diffusers (130; 304; 404; 604; 704; 804) upstream of the outlet along the combined flowpath and oriented to recover the tangential velocity from the combined flow.

2. The ejector of claim 1 wherein:

the plurality of motive flow nozzles are formed along a nozzle ring; and a control ring externally surrounds the nozzle ring and is rotatable to control flow through the nozzles.

3. The ejector of claim 1 wherein:

the suction flow inlet is a single central axial inlet;

the motive flow inlet is a single inlet to an inlet plenum (90), the inlet plenum positioned to feed the motive flow nozzles; and the outlet is a single outlet of an outlet plenum (92), the outlet plenum positioned to receive outlet flows from the diffusers.

4. The ejector of claim 1 wherein:

the motive flow nozzles are convergent-divergent nozzles.

5. The ejector of claim 1 wherein:

there are 4-8 motive flow nozzles and 4-16 diffusers.

6. The ejector of claim 1 wherein:

there are more diffusers than motive flow nozzles.

7. The ejector of claim 1 wherein:

divergent portions of the motive flow nozzles have a tangential orientation component opposite a tangential orientation component of the diffusers.

8. The ejector of claim 1 wherein:

the downstream end centerbody extends to axially overlap the upstream end centerbody.

9. The ejector of claim 1 further comprising:

one or more valves (150; 204) positioned to provide differential control of flow through the respective motive flow nozzles.

10. A vapor compression system comprising:

a compressor;

a heat rejection heat exchanger downstream of the compressor along a refrigerant flowpath;

the ejector of claim 1 with the motive flow flowpath and combined flow flowpath being portions of the refrigerant flowpath downstream of the heat rejection heat exchanger;

a heat absorption heat exchanger upstream of the suction flow inlet; and a return portion of the refrigerant flowpath from the outlet to the compressor.

11. A method for operating the ejector of claim 1 comprising:

passing the motive flow in through the motive flow inlet;

imparting axial and rotational flow components to the motive flow;

entraining the suction flow to the motive flow to form the combined flow;

radially outwardly diverting the combined flow; and reducing a tangential velocity component of the combined flow while expanding the combined flow in the diffusers.

12. The method of claim 11 wherein:

the motive flow and the suction flow each comprise at least 50% by weight carbon dioxide.

13. The method of claim 11 wherein the ejector is used in a vapor compression cycle, the cycle including:

compressing;

heat rejection; and heat absorption.

14. The method of claim 11 further comprising:

differentially controlling flow through respective said motive flow nozzles.

15. An ejector (38; 202; 300; 400; 600; 700; 800) for receiving a motive flow and a suction flow and discharging a combined flow, the ejector comprising:

a motive flow inlet (40);

a suction flow inlet (42);

an outlet (44);

a suction flow flowpath extending from the suction flow inlet; and a motive flow flowpath extending from the motive flow inlet to join the suction flow flowpath and form a combined flowpath exiting the outlet, wherein the ejector comprises:

a plurality of motive flow nozzles (100; 302; 402; 602; 702; 802) along the motive flow flowpath, the motive flow nozzles oriented to impart a tangential velocity component to the motive flow;

a downstream end centerbody (134) having a downstream divergent outboard surface (132; 430; 630) for radially outwardly diverting the combined flow; and a plurality of diffusers (130; 304; 404; 604; 704; 804) along the combined flowpath and oriented to recover the tangential velocity from the combined flow.

16. The ejector of claim 15 wherein:

the plurality of motive flow nozzles are formed along a nozzle ring; and a control ring surrounds the nozzle ring and is rotatable to control flow through the nozzles.

17. The ejector of claim 15 wherein:

the suction flow inlet is a single central axial inlet;

the motive flow inlet is a single inlet to an inlet plenum (90), the inlet plenum positioned to feed the motive flow nozzles; and the outlet is a single outlet of an outlet plenum (92), the outlet plenum positioned to receive outlet flows from the diffusers.

18. The ejector of claim 15 wherein:

the motive flow nozzles are convergent-divergent nozzles.

19. The ejector of claim 15 wherein:

there are 4-8 motive flow nozzles and 4-16 diffusers.

20. The ejector of claim 15 wherein:

an upstream end centerbody (114) has an inner surface (118; 340; 434) downstream of the suction flow inlet and a downstream-converging outboard surface (112; 330; 436) downstream of the motive flow inlet.

21. The ejector of claim 20 wherein:

the upstream end centerbody has a downstream rim (116); and the suction flow flowpath and motive flow flowpath join at the downstream rim.

* * * * *